US005311104A

United States Patent [19]

Antle

[11] Patent Number: 5,311,104

[45] Date of Patent: May 10, 1994

[54] WIDE DIMMING RANGE GAS DISCHARGE LAMP DRIVE SYSTEM

[75] Inventor: Woodrow L. Antle, Plantation, Fla.

[73] Assignee: AlliedSignal Inc., Morris Township, Morris County, N.J.

[21] Appl. No.: 37,492

[22] Filed: Mar. 22, 1993

Related U.S. Application Data

[63] Continuation of Ser. No. 621,703, Dec. 3, 1990, abandoned.

[51] Int. Cl.[5] ..... H05B 41/36

[52] U.S. Cl. ..... 315/307; 315/169.4; 315/DIG. 4; 315/DIG. 7

[58] Field of Search ..... 315/307, DIG. 4, 169.4, 315/291, 209 R, 224, 308, DIG. 2, DIG. 7, 244, 226, 299, 301, 311

[56] References Cited

U.S. PATENT DOCUMENTS

| | | | |
|---|---|---|---|
| 4,253,046 | 2/1981 | Gerhard et al. | 315/224 |
| 4,320,326 | 3/1982 | Banziger et al. | 315/307 |
| 4,739,227 | 4/1988 | Anderson | 315/DIG. 4 X |
| 4,839,564 | 6/1989 | Ide et al. | 315/169.4 |
| 4,920,302 | 4/1990 | Konopka | 315/307 |
| 4,983,888 | 1/1991 | Akutsu et al. | 315/307 X |
| 5,046,152 | 9/1991 | Bartscher | 315/307 |

FOREIGN PATENT DOCUMENTS 2211636 7/1989 United Kingdom .

OTHER PUBLICATIONS

Information Display vol. 5, No. 11, Nov. 1989, New York U.S. pp. 8-13; Mercer & Schoke "fluorescent backlights for LCD's".

Journal of IES, pp. 86-90, Jan. 1983, Lauritzen et al. "A dimmable fluorescent ballast for instrument panel lighting".

*Primary Examiner*—Robert J. Pascal
*Assistant Examiner*—Ali Neyzari
*Attorney, Agent, or Firm*—Howard G. Massung

[57] ABSTRACT

A stable output, widely dimmable light source (20) utilizing a gas discharge lamp (14) including an external igniter (12) which is utilized to provide lamp ignition at approximately the same time as an AC potential source (22) provides power to the lamp (14) cathodes. A high voltage pulse is applied to the external igniter (12) causing ionization of the lamp gasses at the start of each time period during which the ballasted AC potential source (22) is applied to the lamp (14). Average light output level is controlled by a light output selector (36) which controls lamp on time and thus the average light output of the lamp (44). During operation lamp (14) is turned on several times per second, such as sixty-eight and the AC potential source (22) has a relatively high frequency, such as 45 KHz. When utilized for providing backlighting for a liquid crystal display, the average lamp light output can be controlled in response to ambient light to provide proper backlighting in conditions which vary from total darkness to bright sunlight. For LCD applications lamp (14) has a serpentine shape to provide increased and uniform backlighting.

11 Claims, 7 Drawing Sheets

WIDE DIMMING RANGE GAS DISCHARGE LAMP DRIVE SYSTEM

This application is a continuation of application Ser. No. 07/621,703 filed Dec. 3, 1990, now abandoned.

BACKGROUND OF THE INVENTION

1. Field of the Invention

This invention relates to lamp dimming systems and more specifically to a wide dimming range gas discharge lamp drive system.

2. Description of the Prior Art

Systems for controlling the brightness of gas discharge lamps are well known in the prior art, as exemplified by the following U.S. Pat. Nos. 3,449,629; 4,087,722; 4,277,728; 4,320,326; 4,487,481; 4,752,771; 4,760,389 and 4,799,050. Several of these patents deal with providing backlighting for liquid crystal display panels. The present invention is superior to the prior art in providing a wide dimming range and a highly efficient drive which is particularly suitable for backlighting of an active matrix liquid crystal display panel.

SUMMARY OF THE INVENTION

A wide dimming range gas discharge lamp drive system according to the present invention utilizes an external igniter disposed in close proximity or attached to the lamp, a variable ballasted AC voltage source provides power to the lamp cathodes while a short high voltage pulse is applied to the external igniter to provide for lamp ignition. Average light output level of the lamp is controlled by a selector which sets the AC source duty cycle and controls lamp on time, during which the AC voltage source is applied to the lamp.

Application of the AC voltage source to the lamp is through a gate which is controlled by a duty cycle controller to allow bursts of the AC voltage to be applied through a ballast to the cathode of the gas discharge or fluorescent lamp. The ratio of the time when the gate is open and the lamp is on to the time when the gate is closed and the lamp is off, directly determines the lamp's average light output.

The short duration high voltage ignition pulse is generated at or just Prior to the start of each AC burst and is applied to the external igniter which is supported in close proximity to the fluorescent lamp. The ignition pulse is AC coupled through the lamp to the electrodes via the igniter. Gas ionization occurs due to the current flow from the ignition pulse, and thus a small amount of light is emitted. The purpose of the ignition pulse is to ionize the lamp gas just prior to application of the cathode drive. In this way, the lamp is able to sustain cathode current immediately upon application of cathode drive, a lower cathode potential can be used since it is not used to establish the arc, and the lamp can be dimmed to much lower levels. While the AC voltage burst is applied for cathode drive the lamp will produce light. No light is produced during the time between AC voltage bursts being applied to the lamp. The use of an external igniter increases the life of the lamp as no substantial arc discharge is associated with the ignition pulse alone and the magnitude of the AC burst arc is controlled by the ballast.

The disclosed lighting system is particularly suitable for providing backlighting for a liquid crystal display. The fluorescent lamp can be formed in a serpentine shape to increase light output for backlighting of the liquid crystal display. The external igniter can be formed as a backplate behind the serpentine shaped lamp or bonded to the underside of the lamp. The duty cycle controller can be responsive to ambient light to allow optimum lighting of liquid crystal displays under conditions between night and bright sunlight.

BRIEF DESCRIPTION OF THE DRAWINGS

For a better understanding of the invention reference may be had to the preferred embodiments exemplary of the invention shown in the accompanying drawings in which.

DETAILED DESCRIPTION OF THE PREFERRED EMBODIMENTS

Figure 1:
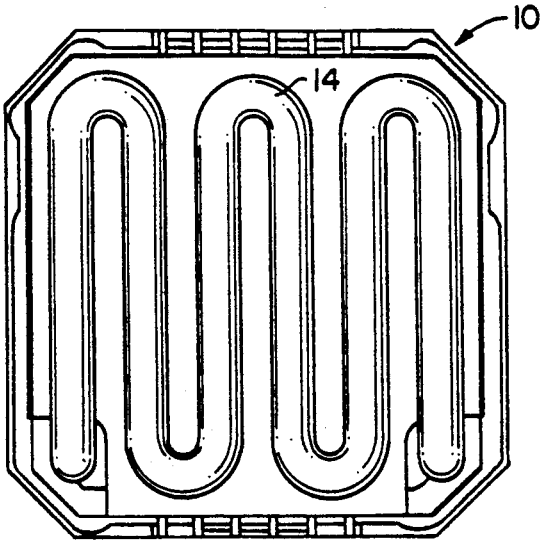
FIG. 1 is a front view of a fluorescent lamp, having an external igniter bonded to its underside according to the teaching of the present invention, for backlighting of a flat liquid crystal display.
Figure 3:
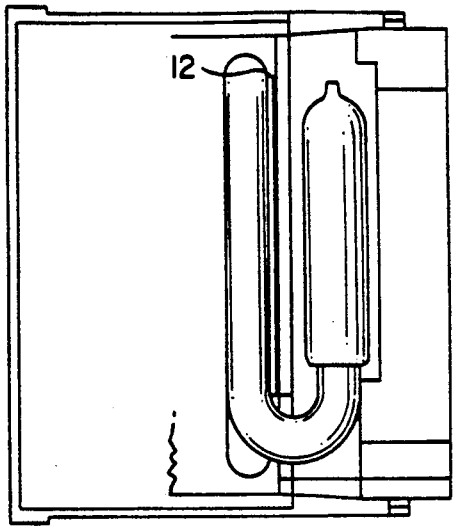
FIG. 3 is a side view of the fluorescent lamp assembly shown in FIG. 1 with portions deleted for clarity.
Figure 2:
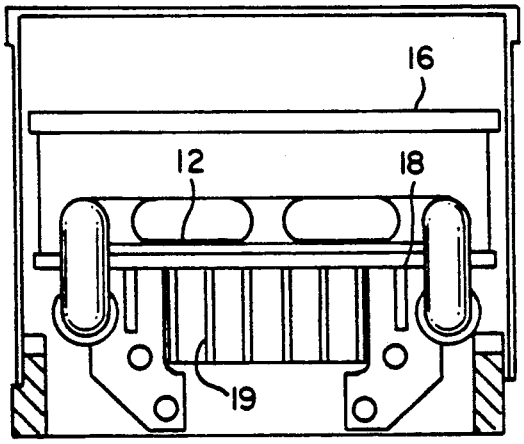
FIG. 2 is a view, partially in section, of the lamp assembly shown in FIG. 1.
Figure 4:
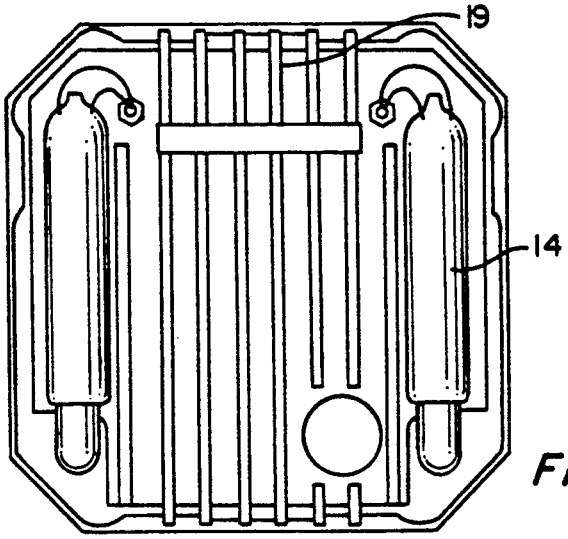
FIG. 4 is a back view of the assembly shown in FIG. 1.

Referring now to the drawings and FIGS. 1 thru 4 in particular there is shown a gas discharge or fluorescent lamp 14, with an attached external igniter 12, for use in a liquid crystal display panel 10. Display panel 10 utilizes a liquid crystal display 16, of a type known in the art. The liquid crystal display 16 is mounted in front of dimmable lamp 14. The liquid crystal display 16 transmits light therethrough as a function of the pixels which are energized. The liquid crystal display 16 can be monochromatic or color. By energizing selected pixels within the liquid crystal display 16 various information and representations can be shown on the exposed front of display panel 10. By varying the backlighting of the liquid crystal display 16, the information or representation shown on display panel 10 can be clearly visible in a wide range of ambient light conditions. The wide range dimmable light source of the present invention is very useful for producing light to illuminate the back surface of the liquid crystal display 16.

External igniter 12 is a thin narrow strip of conductive material bonded to the underside of a lamp 14. Gas discharge or fluorescent lamp 14 is formed with a serpentine shape to permit a brighter and more uniform lighting of the back of liquid crystal display 16. External igniter 12 is disposed in close proximity or bonded to lamp 14. When a high voltage pulse is applied to igniter 12 gasses in fluorescent lamp 14 are ionized. During operation when it is desired to turn on lamp 14, a high voltage pulse is applied to igniter 12 immediately before a ballasted AC voltage source is applied to the cathodes of lamp 14. As the potential of igniter strip 12 rapidly rises the gasses in lamp 14 are ionized, and a small amount of light is emitted. Immediate application of the AC voltage burst source keeps lamp 14 on. The ionization of the gases in lamp 14 is maintained so long as the AC voltage burst is applied thereto. When the AC voltage burst ceases, the lamp extinguishes and goes off. Full plasma discharge within lamp 14 occurs when it is turned on. Plasma density is not a variable when the lamp 14 is on as is the case with some prior art dimming circuits.

External igniter 12 is a thin conducting strip attached to the back side of lamp 14. Lamp 14 is supported on an insulating support 18. Suitable electrical connections are provided to transmit a high voltage trigger pulse to igniter strip 12 and to connect a controlled AC voltage source to lamp 14. A heat sink 19 is provided to assist in removing heat from display 10. A high reflectivity coating is applied to the exposed side of support 18 to maximize the amount of light provided to the back of liquid crystal display 16.

Figure 5:
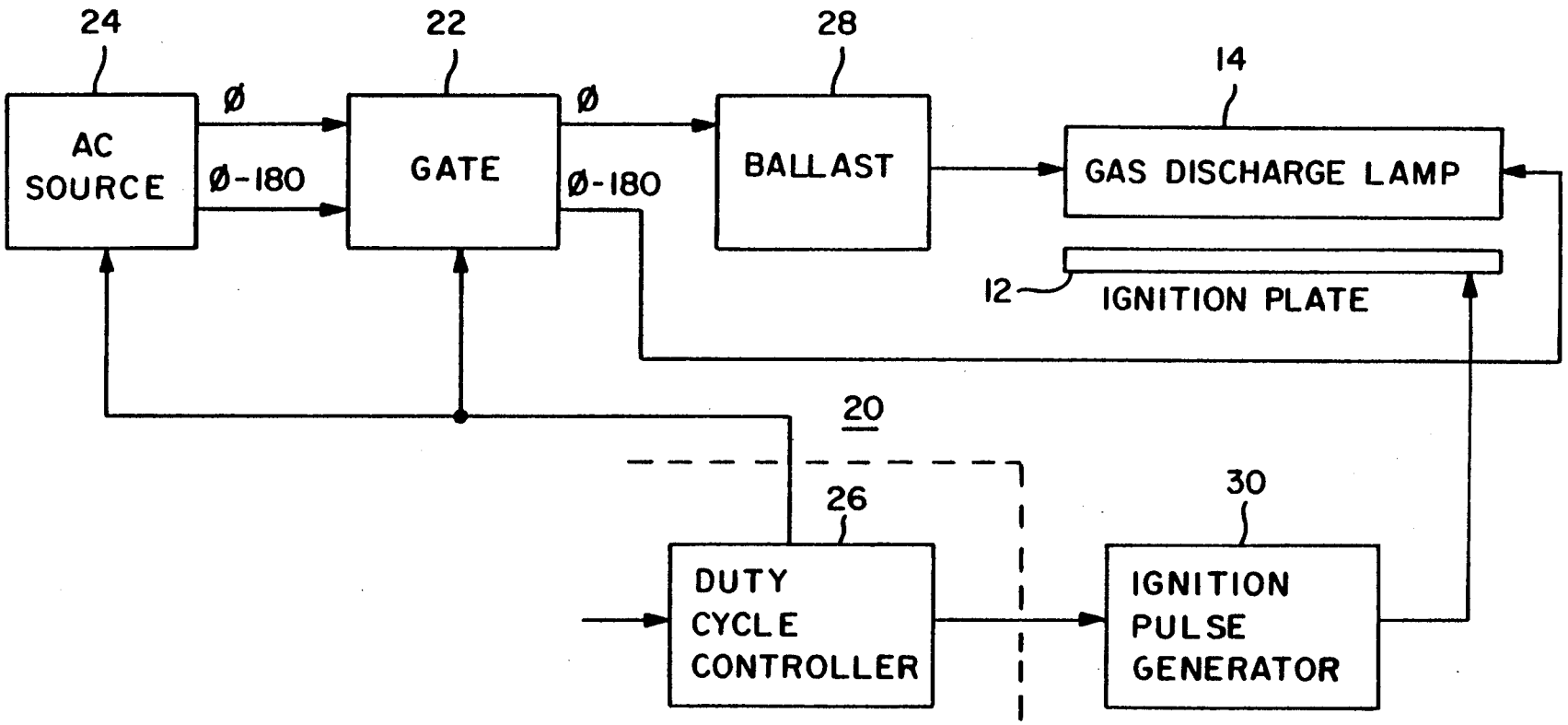
FIG. 5 is a block diagram of a gas discharge lamp dimming drive system according to the present invention.

Referring now to FIG. 5 there is shown a block diagram of a circuit 20 for controlling the light output of fluorescent lamp 14. An AC voltage source 24 is provide. AC voltage source 24 can operate at any desired frequency but is preferably operated at a relatively high lighting frequency such as 45 KHz. The output of AC power source 24 is fed to gate 22. Operational gate 22 is controlled by a duty cycle controller 26 to allow bursts o( AC voltage to be applied through a ballast 28 to the lamp 14. Preferably the AC source is applied sixty-eight times per second. Duty cycle controller 26 also controls operation of an ignition pulse generator 30. Ignition pulse generator 30 applies a short duration high voltage pulse to igniter strip 12 at the start of each AC burst to turn lamp 14 on. The ignition pulse is of a relatively high voltage such as 1.5 KV and preferably has a rapid rate of rise of 1 to 2 microseconds or less. A faster rate of rise of the voltage pulse from ignition pulse generator 30 permits a lower peak value to cause ionization of the gasses in lamp 14. The electric field produced in lamp 14 by the ignition pulse applied to igniter strip 12, which is attached to the lamp 14, ionizes the gas in lamp 14 resulting in a current flow. Thus the lamp is able to sustain cathode current immediately upon application of the AC voltage burst cathode drive. The current flow in lamp 14 will persist for the length of the AC voltage burst, producing light during this time. No light is produced during the time between AC voltage bursts, therefore, the average light output is equal to the ratio of AC burst duration to lamp off time.

Duty cycle controller 26 is responsive to a photodetector which detect ambient light. Duty cycle controller 26 functions to provide the appropriate backlighting for liquid crystal display 16 so that the information displayed thereon is clearly visible under different ambient light conditions, varying from full bright daylight to total darkness.

The duty cycle controller 26 generates the signal that determines lamp 14 intensity. This signal determines the duration of Lamp-On time to Lamp-Off time.

This signal is used to trigger the ignition pulse generator 30 to provide an ignition pulse at the start of every Lamp-On. The signal from duty cycle controller 26 is also used to synchlonize the AC source 24 in order to insure that successive On times are identical. The AC source 24 is then transmitted via gate 22 to the lamp 14 through the ballast 28.

Referring now to FIGS. 6 thru 9 there are shown simplified schematics for various parts of the block diagram dimming circuit 20 shown in FIG. 5.

Figure 6:
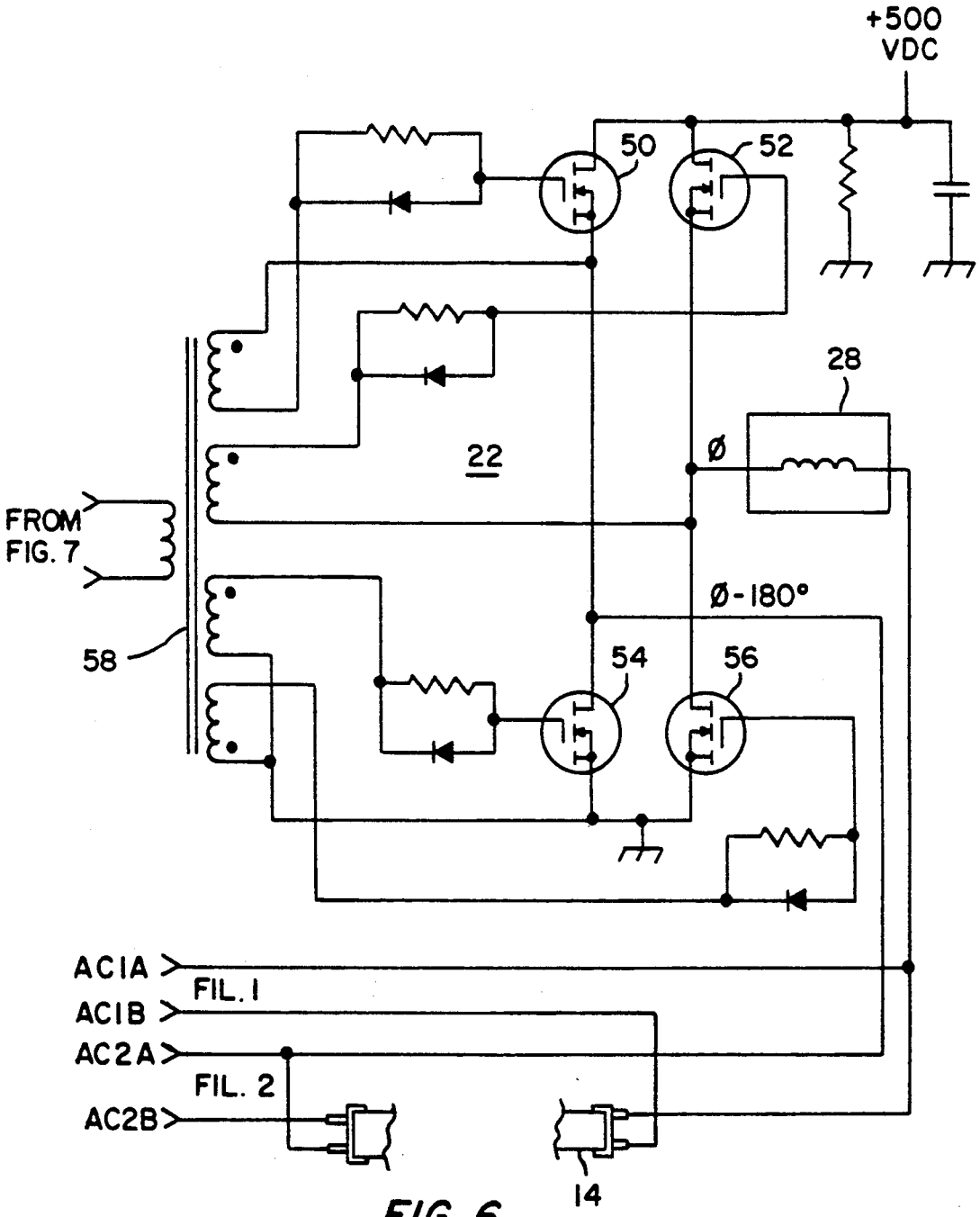
FIGS. 6, 7, 8 and 9 are simplified schematics illustrating in more detail various circuits used in the dimming drive system shown in FIG. 5.

In FIG. 6 there is shown an H-Bridge for driving the series combination of the inductive ballst 28 and the gas-discharge lamp 14. The H-bridge comprises FETs 50,52,54, and 56. Diagonally opposite FETs 50,56 or FETs 52,54 are operated in unision to supply cathods drive current to lamp 14 in series with ballast 28. This configuation yields a nearly triangular current wave form. A drive transformer 58 provides operating signals to the gates of FETs 50,52,54 and 56. A resistor-drive network between the driver transformer 58 and the gate of each FET 50, 52, 54 or 56 insures a fast turn-off and slow turn-on for each FET. In this manner the power dissipation of the H-bridge is minimized.

Figure 7:
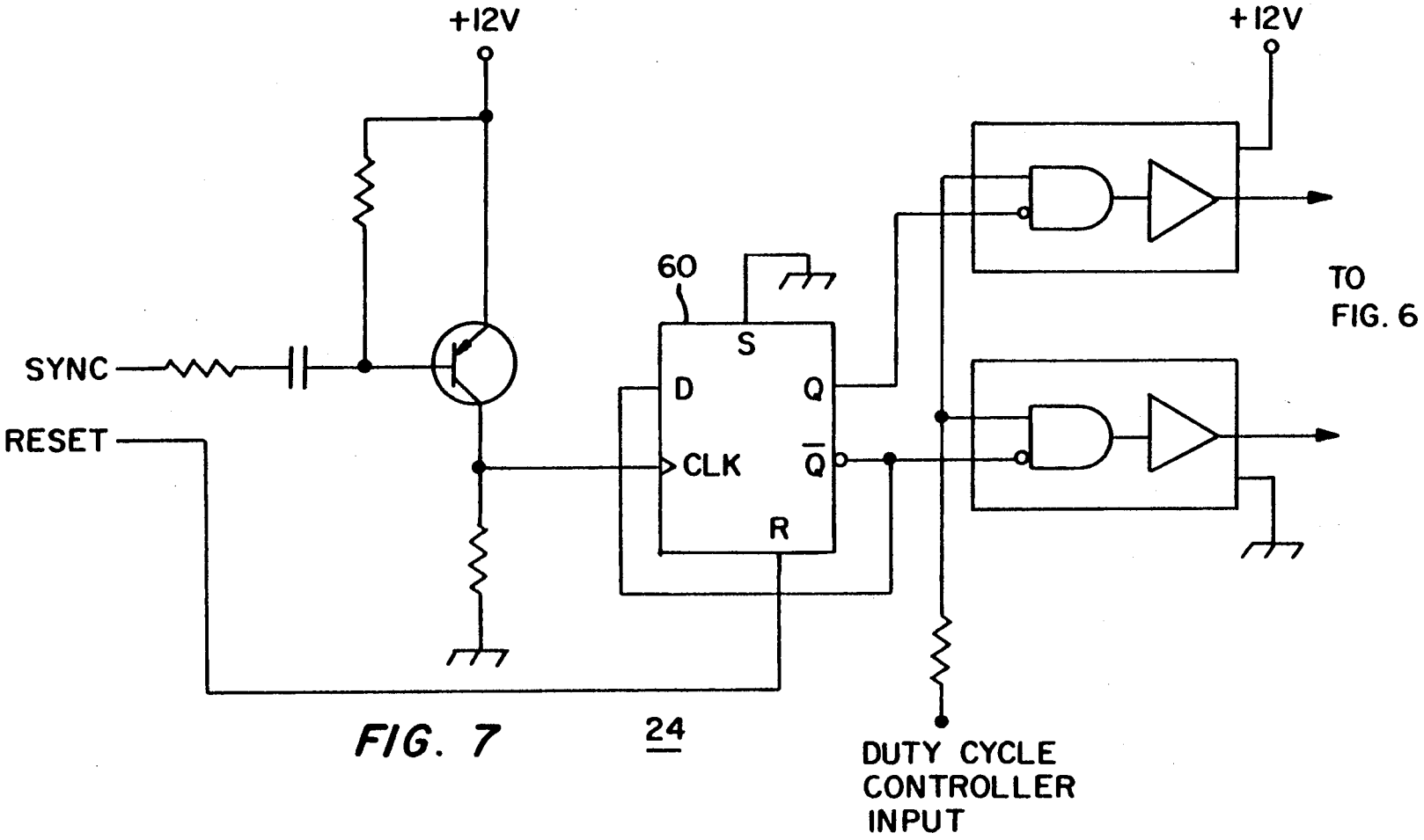

In FIG. 7 there is shown a schematic of the driver transformer 58 exciter circuit 24. A flip-flop 60 is reset on the start of every AC voltage burst rising edge to insure that the lamp 14 is started from the same cathode every time. The flip-flop 60 is used to divide the sync signal by two and to provide a 50% duty cycle drive to the lamp. This control signal from flip-flop 60 is buffered and gated by burst control signals, from duty cycle controller 26, to drive the transformer 58.

Figure 8:
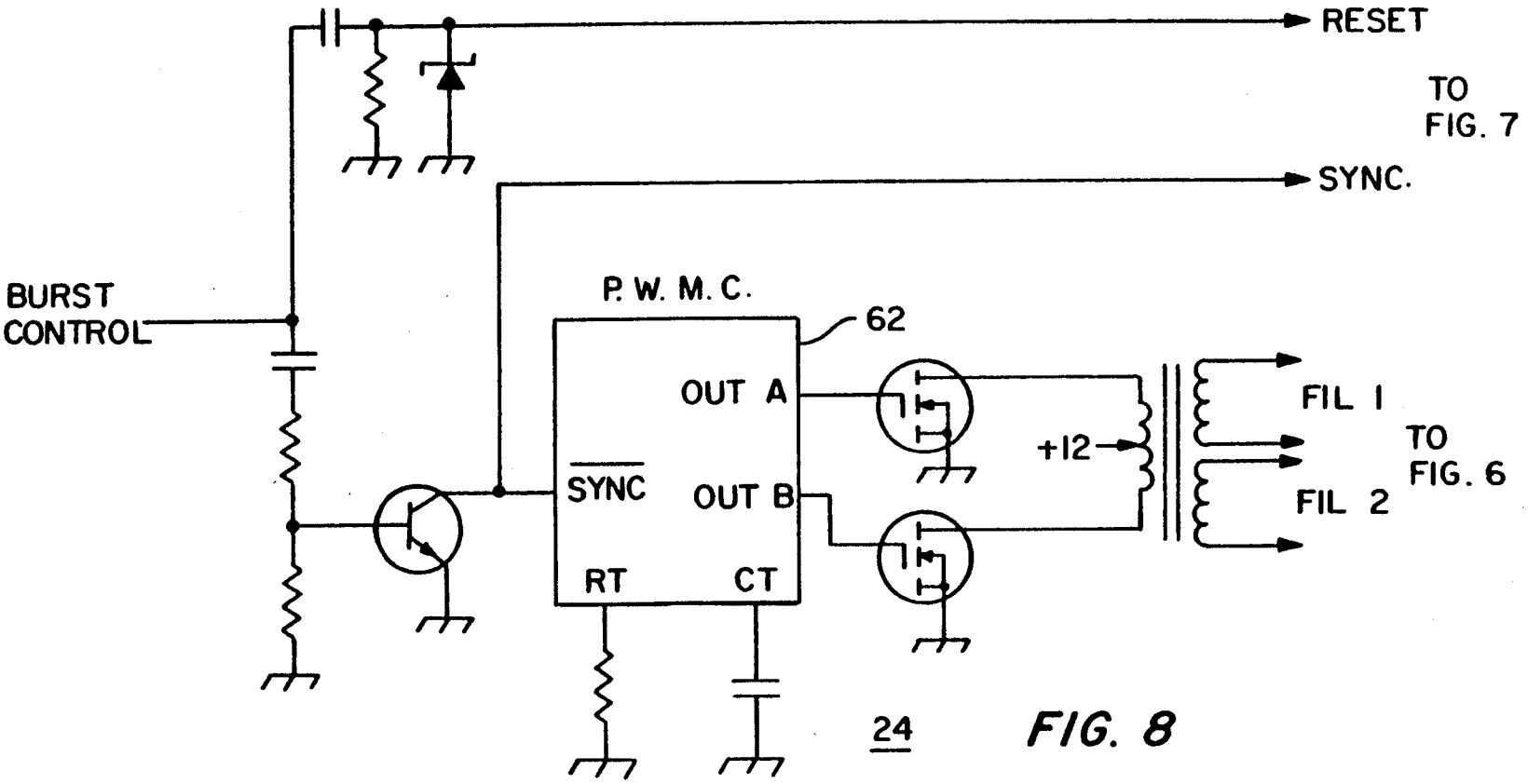

FIG. 8 is a simplified schematic of the AC source oscilator and filament drive circuits. The burst control input signal, from duty cycle controller 26, is a rectangular pulse which determines lamp-on and lamp-off times. When the burst control signal is in its high state the lamp 14 is on. When the burst control signal is in its low state, the lamp 14 is off. The pulse width modulation controller 62 is used to generate the filament drive and the cathode drive. It is capable of restarting its oscillator via its sync input/output pin. This feature is used to prevent lamp 14 starting anomolies from occurring due to the asynchroneity of the oscillator 62 and the burst control signal.

Figure 9:
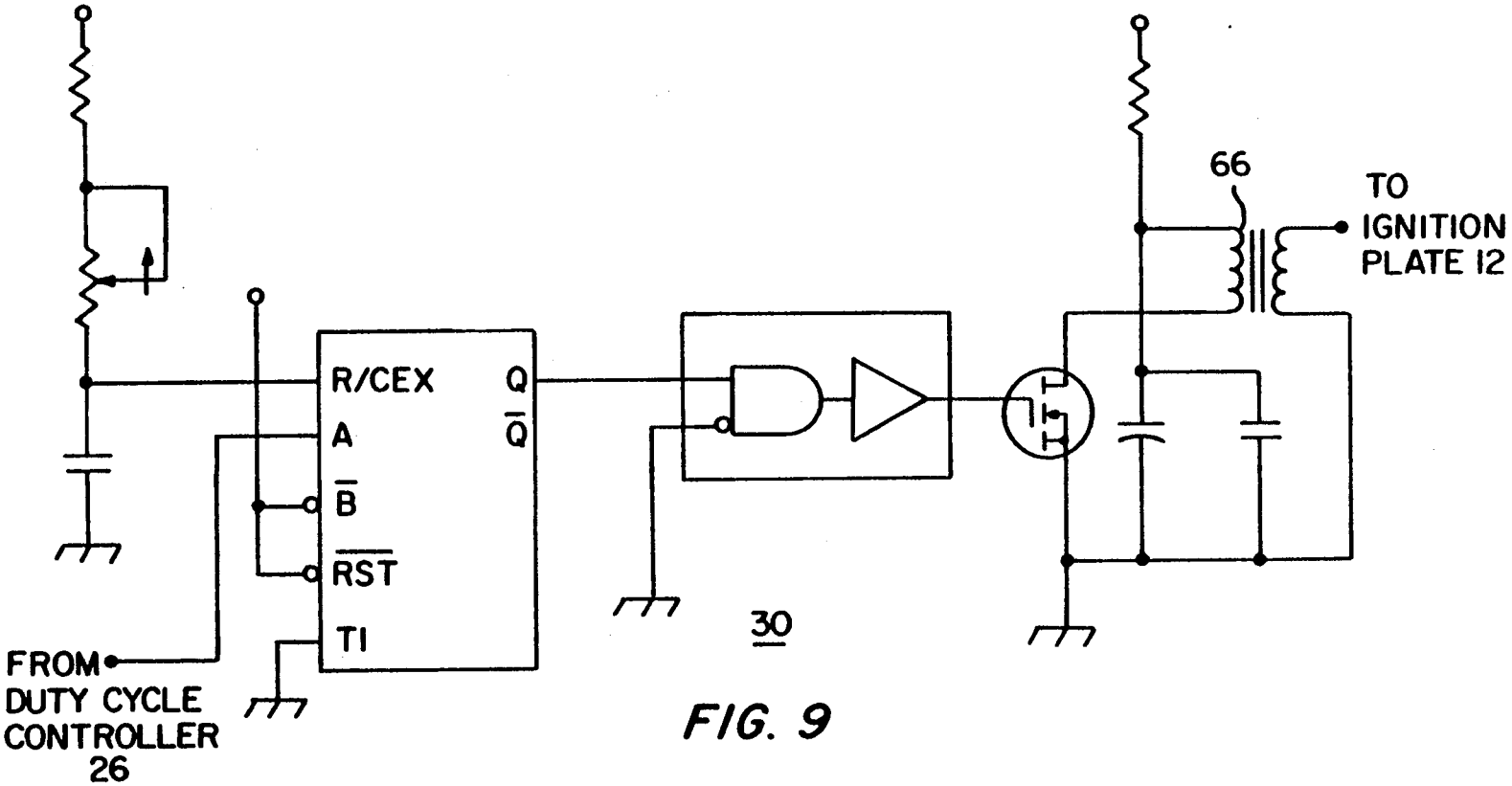

Referring now to FIG. 9 there is shown a schematic of the high voltage pulse generator 30. A monostable oscillator is adjusted to give approximately a 6 $\mu$s pulse to drive the primary of a high volatage transformer 66. The output pulse from transformer 66 is a complex waveshape whose peak voltage of about 1.5 kv is reached in less than 2 $\mu$s. The output ignition pulse is applied to external igniter 12 to start lamp 14.

Figure 10:
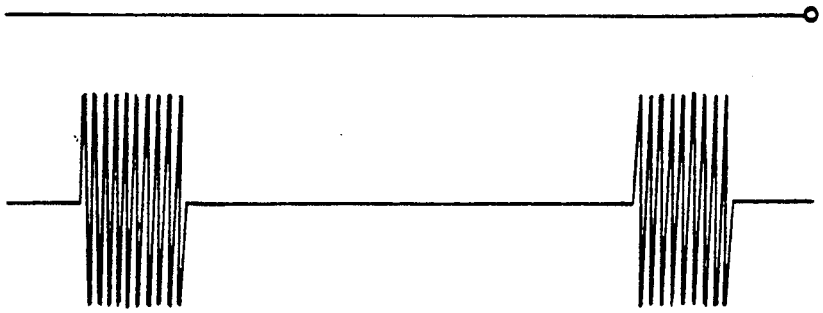
FIG. 10 is a representation of the AC voltage burst applied to the lamp for approximately a 20% duty cycle.
Figure 11:
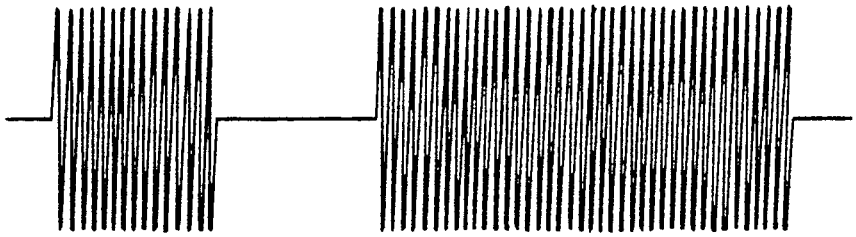
FIG. 11 is a representation similar to FIG. 5 but for approximately a 75% duty cycle.
Figure 12:
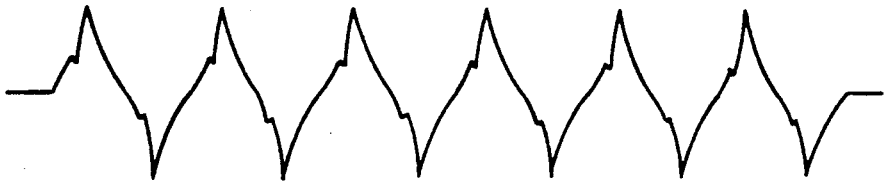
FIG. 12 show the wave shape of the AC voltage burst which is utilized.

Referring now to FIG. 12 there is shown several burst cycles from the AC voltage supply over a short period of time. FIG. 12 shows the triangular waveform of the burst drive voltage applied to lamp 14 when lamp 14 is on. Fractional parts of burst cycles can be applied to lamp 14. During operation preferably at least sixty-eight burst of AC voltage per second are applied to lamp 14. FIG. 10 shows the output for a approximately a 20% duty cycle. FIG. 11 shows the pulses applied to lamp 14 for approximately a 75% duty cycle. The number of 45 KHz cycles applied to lamp 14 is determined by the length of time gate 22 is maintained on.

A dimmable arc discharge lamp circuit 20 according to the present invention provides a high output light source which is capable of being dimmed over a very wide range. The light source driver system is small, light weight, highly efficient and provides a stable light output with environmental variations. Lamp 14 is driven in a manner to maximize its useful light. A highly linear input/output relationship is inherent in the dimming system according to the present invention. The external igniter circuit starts lamp 14 in the least destructive manner, maximizing lamp life. The disclosed dimmable light source is particularly suitable for use with LCD displays used in aircraft cockpits. A wide dimming range allows optimum lighting of LCD displays under conditions between night and bright sunlight. While a system according to the disclosed concept may be applied to any size display, its efficiency and small size lends itself to use in relatively small instruments.

I claim:

1. A wide dimming range drive system for driving a gas discharge lamp from an AC potential source comprising:

a conductor mounted external but in proximity to the gas discharge lamp;

igniter means connected to said conductor for applying a short duration, high voltage pulse to said conductor causing ionization of the gases in the gas discharge lamp;

drive means for applying the AC potential to the gas discharge lamp causing light output; and, control means for controlling times during which said drive means applies the AC potential to the gas discharge lamp for controlling average light output of the lamp.

2. A wide dimming range drive system as claimed in claim 1 wherein:

the gas discharge lamp has a serpentine shape; and said conductor is a thin strip disposed on the serpentine shaped gas discharge lamp and extending along most of its length.

3. A wide dimming range drive system as claimed in claim 1 wherein:

the short duration high voltage pulse has a duration of 2 microseconds or less.

4. A wide dimming range drive system as claimed in claim 2 comprising:

a high light reflectivity member disposed to support said lamp;

insulating means for electrically insulating said highly reflective member from said conductor and wherein, the short duration high voltage igniter pulse has a rapid rate of rise.

5. Dimmable backlighting for a display panel comprising:

a fluorescent lamp;

a power supply having a relatively high frequency AC output;

igniter means disposed external of but in proximity to substantially all of said fluorescent lamp for ionizing the gases in said fluorescent lamp when a high voltage pulse of a relatively short duration with respect to the frequency of the high frequency AC output is applied to said igniter means;

drive means for applying a short duration, high voltage pulse to said igniter means and for connecting said power supply to said fluorescent lamp while its gases are ionized to turn said fluorescent lamp on; and, control means for controlling said drive means for varying the time said power supply is connected to said fluorescent lamp for varying the average light output of said fluorescent lamp.

6. Dimmable backlighting as claimed in claim 5 wherein said igniter means comprises a thin flat electically conducting strip attached to the outside surface of said fluorescent lamp along substantially its entire length.

7. A dimmable fluorescent lighting system comprising:

a fluorescent lamp;

an external igniter disposed on said fluorescent lamp for causing ionization of lamp gases when the external igniter has a high voltage pulse applied thereto;

a relatively high frequency AC voltage source;

gate means for applying said AC voltage source to the fluorescent lamp; and, control means for triggering said gate for selected time periods to control the average light output of said fluorescent lamp and for applying a short duration, high voltage pulse to said external igniter at the start of each selected time period to start said fluorescent lamp.

8. A dimmable fluorescent lighting system as claimed in claim 7 wherein:

said external igniter is a narrow thin electrically conducting strip running along substantially the full length of said fluorescent lamp.

9. A method of controlling the average light output of a gas discharge lamp which can be excited from an AC voltage source comprising the steps of:

(a) disposing an external igniter in close proximity to the gases within the gas discharge lamp;

(b) applying a short duration, high voltage pulse having a rapid rate of rise to the external igniter to ionize the gases in the gas discharge lamp when the lamp is to be turned on;

(c) applying to the gas discharge lamp while its gases are ionized the AC voltage source for selected periods of time which are a function of the desired average light output; and (d) varying the length of the periods of time when the AC voltage source is applied to the gas discharge lamp to vary the average light output of the lamp.

10. A method of controlling the light output of a fluorescent lamp which periodically has an AC voltage applied thereto for variable time periods comprising the steps of:

disposing an external igniter on substantially the entire length of the fluorescent lamp;

applying a short duration high voltage pulse having a rapid rate of rise to the external igniter to ionize the gases in the fluorescent lamp in conjunction with immediately thereafter applying the AC voltage to the fluorescent lamp causing the lamp to turn on; and varying the time periods during which the AC voltage is applied to the gas discharge lamp to change the average light output of the lamp.

11. A dimmable fluorescent lighting system as claimed in claim 7 wherein the high voltage, short duration pulse is less than approximately 2 microseconds.

* * * * *